US005931216A

United States Patent [19]

Carrupt et al.

[11] Patent Number: 5,931,216

[45] Date of Patent: Aug. 3, 1999

[54] ADJUSTABLE CONTINUOUS CASTING MOLD

[75] Inventors: Bertrand Carrupt, Chamoson; Maurice Constantin, Sion; Jean-Pierre Seppey, Champlan, all of Switzerland

[73] Assignee: Alusuisse Technology & Management Ltd., Switzerland

[21] Appl. No.: 08/868,561

[22] Filed: Jun. 4, 1997

[30] Foreign Application Priority Data

Jun. 14, 1996 [EP] European Pat. Off. ..... 96810396

[51] Int. Cl.[6] ..... B22D 11/124; B22D 11/00

[52] U.S. Cl. ..... 164/483; 164/436; 164/443; 164/485; 164/491

[58] Field of Search ..... 164/491, 436, 164/443, 444, 485, 486, 487, 483

[56] References Cited

U.S. PATENT DOCUMENTS

| | | | |
|---|---|---|---|
| 3,685,571 | 8/1972 | Niskovskikh et al. | 164/443 |
| 3,713,479 | 1/1973 | Bryson . | |
| 3,866,664 | 2/1975 | Auman et al. | 164/443 |
| 4,351,384 | 9/1982 | Goodrich . | |

FOREIGN PATENT DOCUMENTS

| | | | |
|---|---|---|---|
| 448752 | 10/1991 | European Pat. Off. | 164/491 |
| 0679460 | 11/1995 | European Pat. Off. . | |
| 2552692 | 4/1985 | France . | |
| 813755 | 7/1951 | Germany | 164/444 |
| 1059626 | 6/1959 | Germany . | |
| 59-73164 | 4/1984 | Japan | 164/491 |
| 1455403 | 11/1976 | United Kingdom . | |
| 9303873 | 3/1993 | WIPO . | |
| 9523044 | 8/1995 | WIPO . | |

*Primary Examiner*—Kuang Y. Lin
*Attorney, Agent, or Firm*—Bachman & LaPointe, P.C.

[57] ABSTRACT

Adjustable continuous casting mold for manufacturing continuously cast ingots of different dimensions, having a mold frame with a pair of stationary facing side walls and a pair of facing end walls, where at least one end wall can be displaced and each side wall and end wall features a primary coolant chamber and, connected to the primary coolant chamber, a plurality of primary coolant channels for jetting coolant onto the ingot material. The displaceable end walls exhibit a secondary coolant chamber and, connected to the secondary coolant chamber, a plurality of secondary coolant channels for jetting additional coolant onto the continuously cast material, the secondary coolant channels being arranged such that the coolant emerging from them strikes the continuously cast material after, with respect to the direction of flow of the cast material, the coolant from the primary coolant channels.

16 Claims, 3 Drawing Sheets

ADJUSTABLE CONTINUOUS CASTING MOLD

BACKGROUND OF THE INVENTION

The invention relates to an adjustable continuous casting mould for manufacturing continuously cast ingots of different dimensions, having a mould frame with a pair of stationary facing side walls and a pair of facing end walls, where at least one end wall can be displaced and each side wall and end wall features a primary coolant chamber and, connected to the primary coolant chamber, a plurality of primary coolant channels for jetting coolant onto the ingot material. The invention also relates to a process for carrying out the continuous casting process with the mould according to the invention.

Continuous casting moulds are used for casting molten metal from a crucible or the like into a given shape; this enables ingots of full or hollow cross-section to be produced. Such continuous casting devices for producing ingots or billets as starting material for further processing, e.g. by extrusion or rolling, comprise a water-cooled mould i.e. a mould which is normally open at the top having parallel walls and a dummy base which initially seals off the mould bottom but can be lowered, the mould walls normally being hollow and filled with water During continuous casting, molten metal is cast at a given rate onto a dummy base which initially forms a seal with the mould frame. The mould frame forms the container for the melt and must therefore be tightly sealed around the whole of its periphery. During the casting process the mould base is lowered and at the same time sufficient molten metal poured into the mould as is required to keep the level of metal there constant. The mould base is therefore lowered at a rate which conforms with the rate of casting.

The mould frame provides the shape of the ingot and, at the same time removes the heat from the melt. When the metal is poured into the mould, the metal solidifies rapidly on the walls and base of the mould, so that at least the outermost edge zone of the melt solidifies within the mould frame. By jetting the ingot emerging from the frame with a coolant, e.g. spraying water onto the ingot, more of the region close to the surface of the ingot emerging from the mould solidifies rapidly with the result that a cup—the contents of which are still liquid—is formed.

When continuous casting metal rolling ingots and such cast blocks, it is normal to employ a special mould for each ingot width. Mainly because of the close dimensional tolerances required, it is complicated and expensive to produce continuous casting moulds. As many different ingot formats are required, it is necessary and uneconomical to keep a corresponding large number of moulds in store.

In order to reduce this problem at least in part, it has been proposed in the German patent document 1 059 626 to produce cast blocks of elongated cross-section by employing a mould comprising a closed ring with parallel side and end walls in which at least one end wall can be displaced within the closed ring. The adjustable wall is set to the desired ingot cross-section prior to casting, the adjustable walls being attached by screws to the rest of the frame.

The mould according to the German patent document 1 059 626 is, however, such that the dummy base of the mould has to be adjusted each time to suit the new ingot cross-section Also, the adjustment of the mould frame to the desired cross-section is very time consuming and normally leads to a long interruption in the production line. This has an unfavourable influence on production time and production costs, especially if only few cast lengths of a particular width are required.

In order to eliminate this disadvantage the patent document FR-83 15766, published under number 2 552 692, describes a mould with a cross-section which may be adjusted during continuous casting, the desired effect being achieved by computer controlled change of inclination of an adjustable end wall. The amount of computer calculation necessary for such control of the cross-section is, however, large—which makes it necessary to employ high powered computer facilities.

During continuous casting the solid edge zone of metal formed in the mould must be able to withstand the total pressure of the ingot material above it also when the ingot has emerged from the mould. The said total pressure comprises the hydrostatic pressure of molten metal and the pressure of the metal already solidified at a higher level. Whereas in the case of stationary vertical mould walls the total pressure acting on the surface of the edge zone depends solely on the hydrostatic pressure of the melt, the total pressure on ingots which are emerging from the mould and do not exhibit a vertical edge zone is determined also by the components of the solidified metal above acting vertically onto the edge zone. Consequently, in the case of moulds with walls that are adjustable during the continuous casting process, the rate of adjusting the mould cross-section to the desired ingot cross-section—especially when increasing the cross-section—depends on the material being cast and on the thickness of the solidified edge zone. In order to avoid scrap, the casting process is preferably started with the adjustable mould at a smaller cross-section than the desired ingot cross-section and the cross-section gradually adjusted accordingly. As a result, because of the thin ingot edge zone formed in the mould, the maximum rate of adjusting the mould cross-section is normally very small. This has a corresponding negative effect especially if a large change in cross-section is required, resulting in a large loss of material as the part of the ingot over which the cross-section varies is usually not suitable for further processing.

SUMMARY OF THE INVENTION

The object of the present invention is to provide an adjustable mould which permits rapid change to the desired ingot cross-section and therefore very cost favourable production of rolling slabs or extrusion billets of different cross-sectional dimensions with one and the same mould.

That objective is achieved by way of the invention in that the displaceable end walls exhibit a secondary coolant chamber and, connected to the secondary coolant chamber, a plurality of secondary coolant channels for jetting coolant onto the continuously cast material, the secondary coolant channels being arranged such that the coolant emerging from the secondary coolant channels strikes the continuously cast material after, with respect to the direction of flow of the cast material, the coolant from the primary coolant channels.

Which walls of the mould frame are designated the end walls and which the side walls is not important for the present invention. Essential to the invention is that the mould frame has at least one displaceable wall according to the invention.

The primary coolant chamber fulfils two functions: on the one hand it serves to cool the shape-endowing part of the mould frame and therefore to remove heat directly from the material being cast and, on the other hand, acts as a coolant supply for the coolant channels which direct the coolant onto the surface of the continuously cast material emerging from the mould—causing the edge zone of the continuously cast ingot to be cooled further. In order to ensure the best possible removal of heat, the primary coolant chamber should have a thin wall between the coolant chamber and the inner wall of the mould frame; at the same time the wall material should exhibit good thermal conductivity.

The secondary coolant chamber is essentially only for conducting coolant into the secondary coolant channels. The coolant flowing through the secondary coolant channels and striking the continuously cast material causes the said cast material in the region of the displaceable end wall to become stronger and to form a thicker stronger edge zone. The thicker edge zone thus formed withstands a higher total pressure from the cast material above it with the result that the continuous casting mould according to the invention allows the mould cross-section to be adjusted faster to the desired ingot cross-section, especially in cases where the cross-section of the mould frame is being increased during the continuous casting process.

The jetting of additional coolant onto the continuously cast material via the secondary coolant channels is necessary only on the displaceable mould walls as the primary cooling of the cast material by means of the primary coolant chamber and the primary coolant channels in the region of the stationary vertical mould walls creates an edge zone which is adequately thick to resist the hydrostatic pressure of the column of metal lying vertically above this edge zone. For that reason the secondary cooling via secondary coolant channels may e.g. be stopped on reaching the desired ingot cross-section. Consequently, the displaceable end walls of the mould according to the invention preferably feature a valve for interrupting the supply of coolant to the secondary coolant chamber or to the secondary coolant channels.

BRIEF DESCRIPTION OF THE DRAWINGS

Regarding the continuous casting mold according to the invention, further advantages, features and details of the invention are revealed in the examples illustrated by the following figures.

DETAILED DESCRIPTION OF THE PREFERRED EMBODIMENTS

Figure 1:
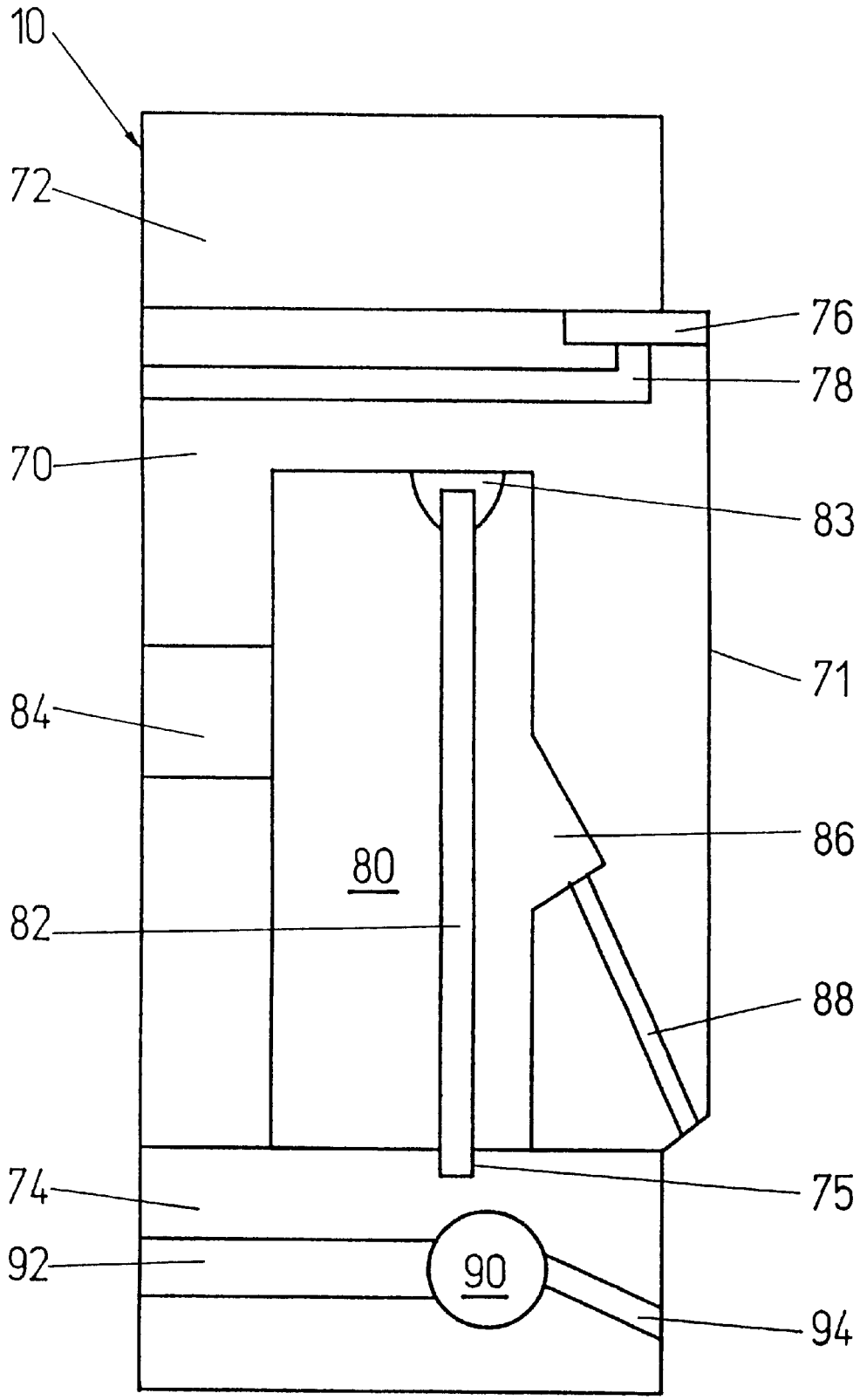
FIG. 1 shows a displaceable end wall of a controllable continuous casting machine according to the present invention.

With the mould according to the invention the adjustment of the mould cross-section to the required ingot cross-section may be effected by simple displacement of the moveable end walls, thus making it unnecessary to make any complicated adjustment to the angle of inclination of the end walls.

The continuously cast ingots normally exhibit slightly concave side faces. This concavity of the ingot surfaces is due to a shrinkage process during the cooling of the melt and occurs especially on the flat sides of long format, rectangular rolling ingots. The curvature of the ingot side walls resulting from the shrinking process depends among other things on the format, alloy and casting rate. Typical values for the depression are 5 to 10 mm per side for rolling ingots of format 300×1000 mm in a Mg-containing aluminium alloy cast at a rate of 5 to 8 cm per minute. Such deviations from a flat surface are undesirable in that they increase the amount of scrap on scalping and lead to difficulties with straightness during rolling.

In order to avoid concave sides, the inner faces of the continuous casting mould are domed outwards to compensate for the degree of shrinkage. The molten metal leaving the mould exhibits therefore outward curved side walls which then shrink and become flat.

According to the invention the primary and secondary coolant channels are made such that the coolant flowing out of the secondary coolant channels strikes the continuously cast material after—in terms of the direction of flow of the cast material—the coolant from the primary coolant channels. The primary coolant channels are preferably such that their long axis forms an acute angle of 20 to 40° to the central axis of the hollow space within the mould, defined by the mould frame. By the central axis of the hollow space within the mould is understood the central axis lying parallel to the direction of flow of the continuously cast material. The longitudinal axis of the second coolant channel preferably makes an angle of 60 to 85° with the central axis of the space inside the mould.

The number of primary coolant channels depends among other factors on the size of the ingot to be cast, the rate of casting and the material being cast. Each side wall has preferably 8 to 30 primary coolant channels, and the stationary end walls 5 to 25 thereof The openings from the primary coolant channels directed towards the hollow space within the mould are all preferably arranged in the same cross-sectional plane of the mould. In addition the coolant channels are preferably arranged such that the whole of the ingot cross-section is uniformly sprayed by coolant.

The number of secondary coolant channels depends among other things, on the length of the displaceable end wall or the ingot cross-section, on the material being continuously cast and on the rate of adjustment of the mould cross-section to the desired ingot cross-section. The number of secondary coolant channels per displaceable side is preferably between 8 and 30.

The outlets from the secondary coolant channels directed towards the mould interior are all preferably situated on the same cross-sectional plane of the mould and are preferably arranged such that the side of the ingot next to the displaceable side walls is the jetted uniformly by coolant.

On the part of the inner wall of the mould frame facing the mould interior in the region of inflow of metal, the continuous casting mould according to the invention preferably contains a lubricant distributor for supplying lubricant at least to the whole of the shape-endowing part of the inner wall which is exposed directly to the continuously cast material. Essential is that a lubricating or slip promoting agent is introduced between the continuously cast material and the whole of the part of the mould frame mechanically exposed directly to the continuously cast material i.e. the shape-endowing inner wall of the end and side walls facing the mould interior.

The element for distributing the lubricant may be in the form of a closed ring-shaped element or as a plurality of partial elements situated a distance apart from each other on the same cross-sectional plane of the mould. A closed ring-shaped lubricant distributor usefully comprises four elongated partial elements lying in the same cross-sectional plane of the mould, each end and side wall featuring such a partial element. A lubricant distributor comprising a plurality of partial elements arranged a distance apart from each other usefully has these partial elements all in the same cross-sectional plane of the mould, the arrangement and/or the shape of the partial elements preferably being such that the lubricant or slip promoting agent is distributed uniformly over the whole of the shape-endowing inner wall of the mould frame.

The supply of coolant and lubricant to the displaceable end walls takes place preferably via flexible hoses which are of a length that does not hinder the movement of the end walls.

In a preferred version of the mould according to the invention the end and side walls are of modular construction, and are such that each end and side wall features a middle part containing the primary coolant chamber and the primary coolant channels, and two enclosing sections running in the longitudinal direction of the mould on both sides of the middle part, and the inner walls of the middle part facing the continuously cast material form the shape-endowing surface of the mould. The longitudinal direction of the mould defines an axis lying parallel to the direction of flow of the material being cast. The front enclosing section, i.e. with respect to that direction of flow, is defined in the following as the first enclosing section, the subsequent enclosing section—again with respect to the direction of flow—on the middle part is defined as the second enclosing section. During casting, therefore, the continuously cast material flows first through the part enclosed by the first enclosing sections, then through the part enclosed by the middle part and finally through the part of the mould frame enclosed by the second enclosing sections. Highly preferred is for the middle part to exhibit an essentially U-shaped longitudinal section such that, on fitting the second enclosing section to the middle part, a hollow space forms the primary coolant chamber Highly preferred is for the middle part to have a U-shaped longitudinal section such that on fitting the middle part to the second enclosing section, a space representing the primary coolant chamber is formed.

The inner wall of the end and side walls facing the mould interior may all together enclose a cylindrical shaped space, usefully a space of quadratic cross-section. Thereby, the individual inner walls need not constitute one single surface lying parallel to the longitudinal axis of the mould. On the contrary the mould interior may be formed by a plurality of sequentially arranged partial mould spaces.

The space enclosed by the enclosing sections of the end and side walls exhibits e.g. a larger cross-section than that space formed by the middle parts of the end and side walls. In such a mould the space formed by the middle part is of smaller cross-section and is responsible, therefore—as a result of the cooling provided by the inner wall—for the shaping of the continuously cast material.

The shaping of the cast material is preferably effected by the middle parts of the end and side walls. The shape-endowing inner wall of each middle part therefore preferably projects out beyond the corresponding inner wall of the second enclosing section. By projecting inner wall of the middle part is to be understood the position towards the central axis of the mould space. Also preferred is for the shape-endowing inner wall of each middle part to be projecting out beyond the corresponding wall of the first enclosing section.

In a further preferred exemplified embodiment of the continuous casting mould according to the invention, the second—as viewed with respect to the direction of flow of the cast material —enclosing sections of the displaceable end walls house the secondary coolant chamber and the secondary coolant channels.

The end and side walls of the mould according to the invention may be of any material of choice which provides the mould with adequate mechanical strength and thermal resistance as well as adequate permanence of shape. In the case of moulds of modular construction the individual elements of the mould may be of the same or different materials. Usefully, the end and side walls or parts thereof are of metal.

In accordance with the present invention the width of the ingot can be set by programme-control of the mould opening or distance between the side walls, whereby this may be achieved either by displacing only one end wall or e.g. by counter-movement of both end walls. Normally, it suffices to set the ingot width by adjusting the distance between a pair of facing end walls, however, by moving only one end wall. In the following description, therefore, the mode of adjustment is considered to involve the adjustment of only one single end wall per mould, this although for some mould designs it may be advantageous to adjust the position of both end walls symmetrically and to the same degree with respect to the centre of the mould. The present object of the invention includes, however, the adjustment of the mould opening by setting only one end wall and the simultaneous setting of both facing end walls.

Using the mould according to the invention the distance between the end walls may usefully be varied over a range of 10 to 1000 mm, in particular over a range of 100 to 500 mm.

The drive for the displaceable end walls may be achieved e.g. by mechanical, hydraulic, pneumatic or electromagnetic means. Usefully the positioning and securing of each displaceable end wall is achieved via at least one axle shaft running e.g. parallel to the direction of movement of the end wall; the said shaft may be in the form of a solid or hollow section or in the form of a piston-shaped element.

Each displaceable end wall is positioned e.g. via at least one axle shaft with the aid of a given programme. If only one axle shaft per end wall is employed, the shaft is usefully situated at the middle of the end wall. If more than one axle shaft is employed, it must be assured that all shafts participating in the movement of the end wall move in synchrony.

The thrust required to position and secure the end wall in place is usefully provided by a drive shaft powered by a motor, whereby the rotary movement of the drive shaft may be converted into a thrust in the direction along the axial shaft by means of gearing. If a plurality of axial shafts are employed for positioning the end wall, or if a plurality of continuous casting moulds according to the invention is parallel driven, the axial shafts involved are preferably driven by the same drive shaft in order to ensure synchronous movement.

Gearing which comes into question are e.g. pulling means, toggle joints, screw or wheel type gears. Preferred are wheel type gears in the form of single or multi-step cog gears. These permit non-slip transmission of the rotary movement of the drive shaft to the axial shaft(s) with a defined transmission ratio.

Suitable cog wheel gears are e.g. cylindrical spur wheels, bevel wheels or worm wheels. Thereby, the cylindrical cog wheels my be straight, inclined, arrow-shaped (herring-bone wheels), or screw shaped (spiral wheels), with internal or external threads. Bevel wheels exhibit a conical periphery with straight, inclined or curved threads.

The displacement of the side wall necessary for adjusting the mould opening may take place e.g. by means of an axial shaft securely attached to the side wall, the other end of the shaft being in the form of a threaded rod onto which a drive shaft with permanently attached cog wheel engages, if desired via transmission gearing.

Attaching the axial shaft(s) to the end wall may be achieved e.g. by bolting, clamping, riveting or welding. Releasable connections are preferred, however, to permit easy replacement of parts of the mould that are subject to wear.

Another possibility for converting the rotary movement of the drive shaft to a displacement of the end wall is for example to transmit the rotary movement of the drive shaft to the axial shaft(s) by torque transmission using gearing such as e.g. cog wheel gearing in which each of the drive and axial shafts has a cog wheel permanently attached to the shaft. The turning movement of the axial shaft(s) can then be converted into an axial movement of the end wall e.g. by means of spindle gearing i.e. in a threaded opening in the end wall or in a projection on the end wall in which the thread on the outside of the spindle engages.

The use of the described mould according to the present invention for the production of continuously cast ingots of different dimensions and mould base of fixed dimensions shows considerable advantage both in terms of production time and costs compared with a conventional mould with end walls attached to the related side walls by means of screws or the like.

Compared to the known, state-of-the-art adjustable continuous casting moulds in which the mould cross-section has to be decided before casting, the mould according to the invention permits the ingot cross-section to be set during casting, with the result that there is no interruption in the production line for manual adjustment of the mould cross-section. This advantage is particularly effective when casting with several continuous casting moulds in parallel, as all of the mould openings together or individually can be adjusted e.g. by means of the same drive shaft or a plurality of drive shafts. In addition, the mould according to the invention makes it possible to adjust the ingot dimensions continuously, whereas with the known moulds with end walls that have to be adjusted prior to casting, there are normally only 3 to 5 positions available at which the end walls can be set.

The mould according to the invention can be adjusted to the desired ingot cross-section at a much higher rate than is possible with a mould whose cross-section is altered by changing the angle of inclination of the end walls; furthermore, the displacement of the end wall by means of gearing enables the change of cross-section to be carried out in a simpler manner and achieving greater accuracy in the ingot cross-section.

The continuous casting mould according to the invention is suitable for continuous production of rolling ingots or extrusion billets of light weight metal or light metal alloys, in particular for continuous production of rolling ingots or extrusion billets of alloys of aluminium or magnesium.

The invention also relates to a process for continuously casting metal ingots by means of a continuous casting mould according to the present invention in which the mould dummy base which can be moved downwards exhibits fixed dimensions and the positioning of each end wall takes place by means of a drive which can be regulated by a control unit.

According to the invention, initially, the distance between the end walls is set such that, at the start of the casting process, the cross-section of the mould interior corresponds to the surface area of the mould dummy base—which can be lowered—available to accommo-date the material being cast and, in the course of the continuous casting process the distance between the end walls is adjusted by means of the drive regulated by the control unit in such a programme-controlled manner, in co-ordination with the lowering of the mould dummy base, that the cross-section of the mould interior is adjusted continuously or stepwise to the dimensions of the ingot desire.

The adjustment of the spacing between the end walls effected by the control unit is made according to a given programme, a target value curve, as a function of time.

Also preferred is for the position of each adjustable end wall to be measured at each point in time by a position measurement facility, so that the positioning of the end wall effected by the control unit and drive mechanism takes place on the basis of the difference between the time-dependent position of the end wall concerned and a time-dependent position calculated by a given programme.

The cross-section of the column of molten metal at the start of the process according to the invention is usefully smaller than the cross-section of the ingot to be produced. In the course of lowering the mould dummy base the mould opening can then be altered either continuously or in steps in such a manner that the cooled ingot exhibits the desired cross-section, except at the start over the distance in which the cross-section was being adjusted. This initial part of the ingot is e.g. essentially conical in shape, or it exhibits e.g. several conical parts one after the other. The simple or step-shaped conical start to the ingot may e.g. be in the shape of a blunted pyramid or a blunted cone.

The shape of the conical parts of the ingot is essentially a result the rate of change of the distance between the end walls in conjunction with the rate of lowering the mould dummy base. The control of the process is preferably such that the surface normal of the resulting conical part of the ingot makes an acute angle of at least 25°, in particular an angle of 30 to 80° to the longitudinal axis of the ingot.

In order to minimise the amount of scrap material during the subsequent processing of the ingot, the maximum depth to which the dummy base is lowered before reaching the constant, desired ingot cross-section, i.e. the height of the blunted pyramid or blunted cone part of the ingot, is usefully less than 50 cm, in particular less than 30 cm.

Compared with the known continuous casting process, the process according to the present invention—as a result of the continuous adjustment of the mould opening—enables continuously cast ingots to be produced with any desired dimensions at a favourable cost, whereby the initial part of the ingot which is normally not useable in the subsequent processing is very much smaller than is the case with ingots produced using state-of-the art adjustable moulds.

The longitudinal section through a displaceable end wall 10 in FIG. 1 shows by way of example its modular construction. The end wall 10 comprises a middle part 70 and two enclosing sections 72, 74 on both sides of the middle part 70 in the longitudinal direction of the mould. The middle part 70 exhibits a U-shaped longitudinal recess. With the attachment of the second—as viewed in the direction of metal flow—of the enclosing sections 74 to the middle section 70 a primary coolant chamber 80 is formed in the displaceable end wall 10. The end wall 10 features a coolant supply channel 84 for feeding coolant to the primary coolant chamber 80.

Primary coolant channels 88 for jetting the cast ingot with coolant are provided in the end wall 10; these channels 88 are connected to the primary coolant chamber 80 and are arranged such that the coolant meets the continuously cast material at an acute angle of about 30 ° to the central axis of the mould space 12. All angles in the present text refer to a circle of 360°. In order to ensure that an adequate amount of coolant enters the primary coolant channels 88, each of the primary coolant chamber 80 features a channel entry recess 86 at the inlet to primary coolant channels 88.

As means for reducing turbulence, the primary coolant chamber 80 shown in FIG. 1 contains a dynamic flow element in the form of a dividing wall 82 with openings which are not shown here. The dividing wall 82 is attached at one end by a mass 83 e.g. in the form of a suitable putty, cement or the like. The other end of the dividing wall resides in a groove 75 in the second enclosing section 74.

The longitudinal section of an end wall 10 shown in FIG. 1 also shows, in the region of the inner wall 71 of the middle part 70 facing the interior 12 of the mould, a lubricant distributor 76 for supplying lubricant to the inlet region of the middle part 70. The supply of lubricant or slip-promoting agent to the lubricant distributor 76 takes place via the lubricant supply channel 78. The lubricant distributor 76 is—as viewed in the direction of flow of the continuously cast material—partly covered in the region of metal inflow by the first enclosing section 72.

The second enclosing section 74, i.e. second as viewed in the direction of casting, exhibits the secondary coolant chamber 90 according to the invention and secondary coolant channels 94 for jetting the ingot with further coolant. The longitudinal section through the displaceable end wall 10 shows the secondary coolant supply means 92 for feeding coolant to the secondary coolant chamber 90. The secondary jetting of the ingot 54 necessary to the displaceable end wall 10 according to the invention is performed by the coolant flowing through the secondary coolant channels 94 which are connected to the secondary coolant chamber 90 and are supplied by coolant from that chamber 90.

Figure 3:
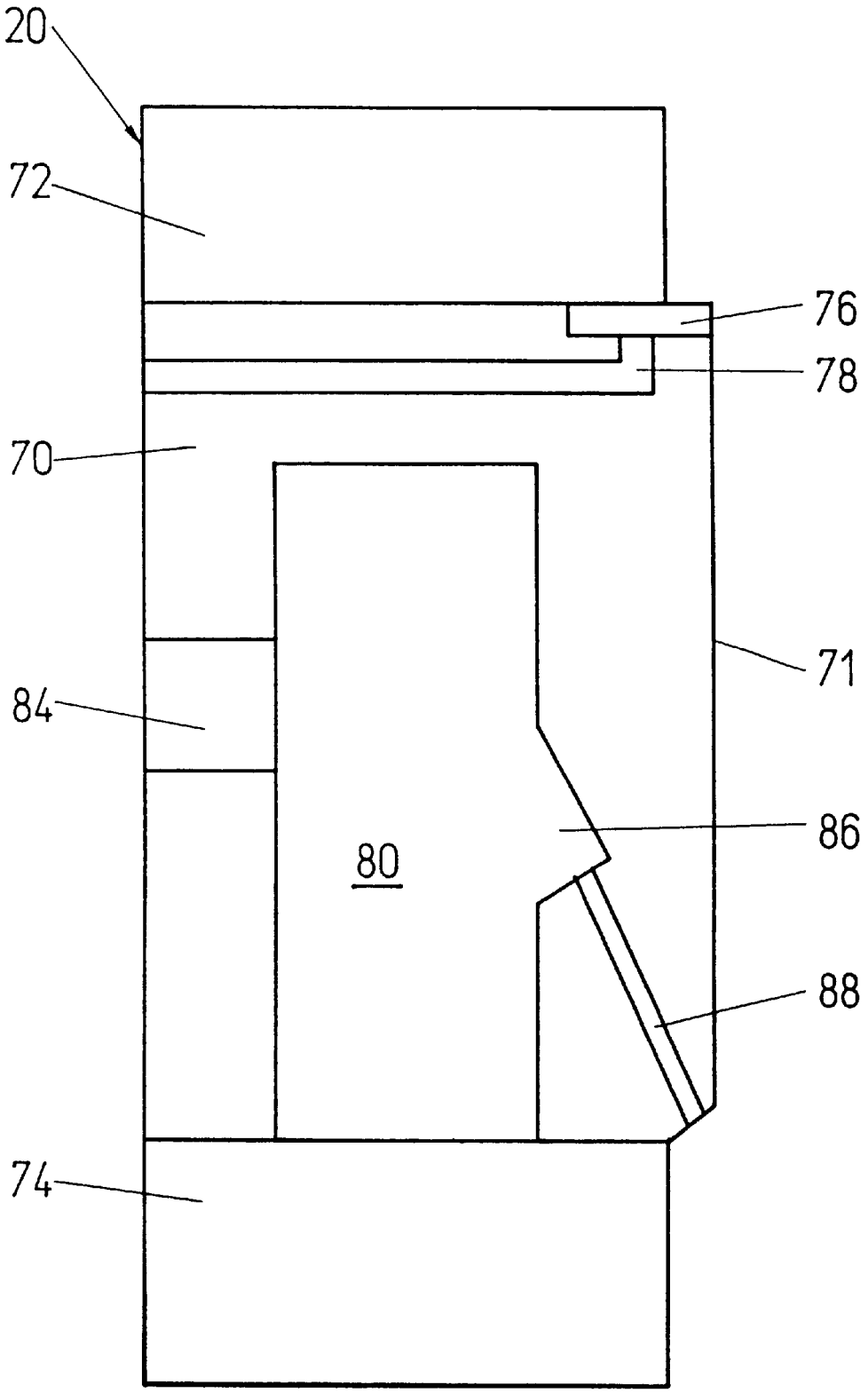
FIG. 3 shows a side wall of a continuous casting mold according to the present invention.

In a preferred version of the mould according to the invention the construction of side walls 20 and the end wall, which is possibly attached permanently to the side walls 20, corresponds to that of displaceable end wall 10—up to the secondary coolant supply channels 94 contained in the second enclosing section, the secondary coolant chamber 90 and the secondary coolant supply line 92. Thus, FIG. 3 shows a side wall 20 of a continuous casting mold according to the present invention including middle part 70 and two enclosing sections 72, 74 on both sides of middle part 70 in the longitudinal direction of the mold. Primary coolant chamber 80 is formed in side wall 20 including coolant supply channel 84 for feeding coolant to the primary coolant chamber 80 and primary coolant channels 88 for jetting the cast ingot with coolant connected to the primary coolant chamber 80. FIG. 3 also shows lubricant distributor 76 and lubricant supply channels 78.

Figure 2:
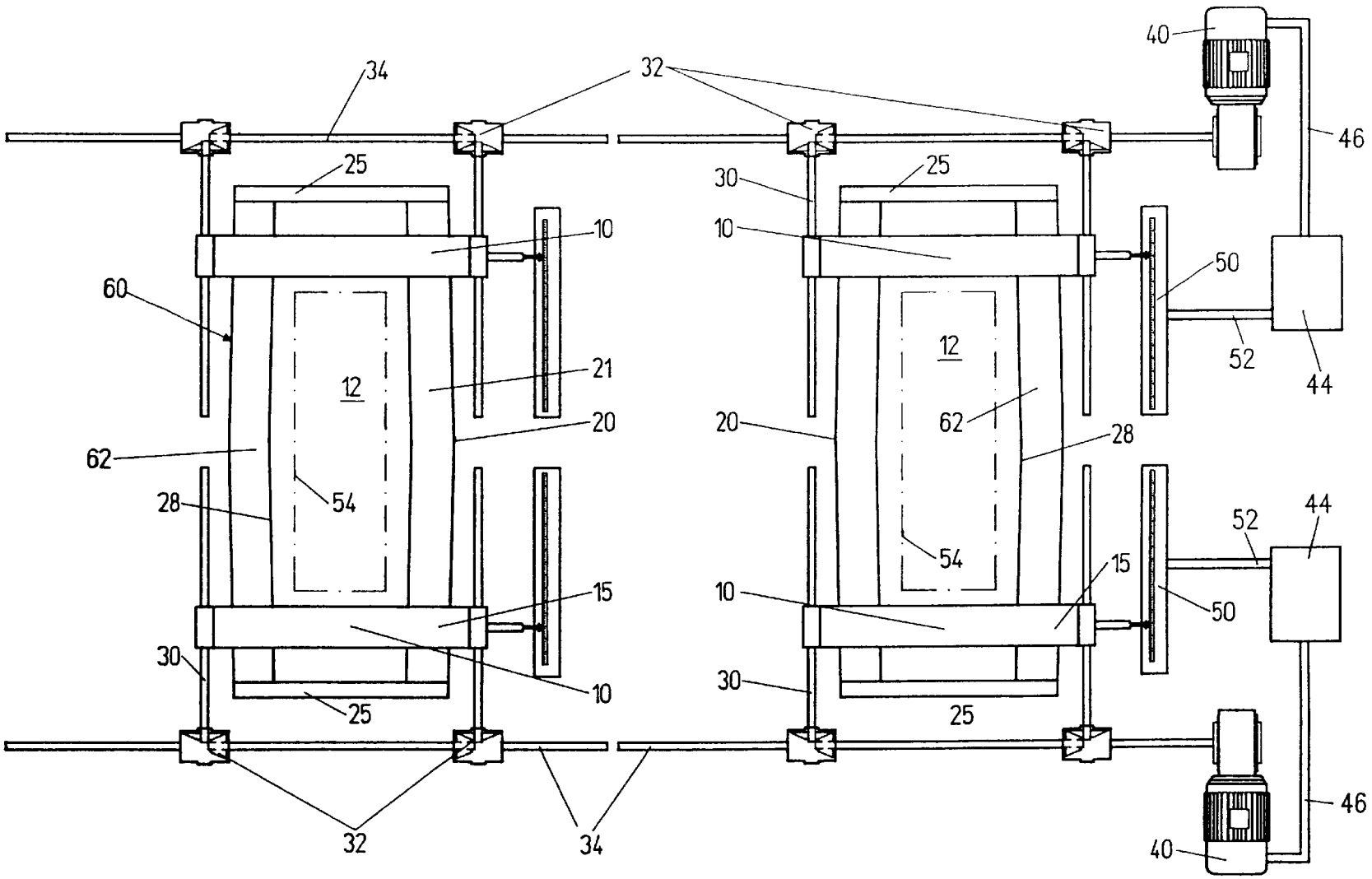
FIG. 2 shows a plan view of a system of controllable continuous casting molds.

FIG. 2 shows a system of adjustable continuous casting moulds in which, for reasons of clarity, only two moulds 60 are shown by way of example. Each mould 60 exhibits a mould frame 62 containing a pair of facing end walls 10 all four of which together enclose a space, the mould interior 12. The mould interior 12 defined by the inner wall 28 of the mould frame 62 serves to accommodate the continuously cast material. The inner wall 28 contains the cooling chambers 80, 90 by which at least the edge region of the cast material is cooled, causing the material to solidify at least in this edge zone and leave the mould in the form of an ingot 54 (indicated by broken line).

The side walls 20 of each mould 60 are permanently joined together a predetermined distance apart by sections 25. The end walls 10 are displaceably mounted by means of sliding bars 15 which exhibit recesses into which alignment rails attached to the surface 21 of the side walls 20, but not shown here, and are moved by means of axle shafts 30. The axle shafts are connected via a gearing 32 to the driving shaft 34 for a series of parallel continuous casting moulds 60. The driving shaft 34 is driven by a motor 40, the regulation of the motor being performed by control unit 44 according e.g. to a given programme based on input data on the position of the end wall 10 provided by the positioning measurement device 50. The current position of each displaceable end wall 10 is transmitted via a measurement signal line 52 to the control unit 44. The control signal required for the drive 40 is transmitted from the control unit 44 by cable 46.

We claim:

1. Adjustable continuous casting mold for manufacturing continuously cast ingots of different dimensions from continuously cast material having a direction of flow, which comprises: a mold frame having a pair of stationary facing side walls and a pair of facing end walls defining a modular rectangular construction, wherein at least one end wall can be displaced and each side wall and each end wall includes a primary coolant chamber; a plurality of primary coolant channels for jetting coolant onto the ingot material, connected to said primary coolant chamber; a secondary coolant chamber only in said displaceable end walls; and a plurality of secondary coolant channels connected to the secondary coolant chamber for jetting coolant onto the continuously cast material, the secondary coolant channels being arranged such that the coolant emerging from said secondary coolant channels strikes the continuously cast material after, with respect to the direction of flow of the cast material, the coolant from the primary coolant channels.

2. Continuous casting mold according to claim 1, wherein the longitudinal axis of the primary coolant channels form an acute angle of 20 to 40 with the central axis of the mold interior delimited by the mold frame.

3. Continuous casting mold according to claim 1, wherein the longitudinal axis of the secondary coolant channels form an angle of 60 to 850 with the central axis of the mold interior delimited by the mold frame.

4. Continuous casting mold according to claim 1, wherein said mold frame includes an inner wall of the mold frame facing the mold interior in the region of inflow of metal and wherein said inner wall contains a lubricant distributor for supplying lubricant to at least the whole of the shape-endowing part of the inner wall which is exposed directly to the continuously cast material.

5. Continuous casting mold according to claim 1, wherein the end and side walls are of modular construction, and are such that each of the end and side walls features a middle part containing the primary coolant chamber and the primary coolant channels, and two enclosing sections running in the longitudinal direction of the mold on both sides of the middle part, and the inner walls of the middle part facing the continuously cast material form the shape-endowing surface of the mold.

6. Continuous casting mold according to claim 5, wherein the middle part has a U-shaped longitudinal section such that on fitting the middle part to the second enclosing section, a space representing the primary coolant chamber is formed.

7. Continuous casting mold according to claim 5, wherein the shape-endowing inner wall projects beyond the side of the second enclosing section facing the mold interior.

8. Continuous casting mold according to claim 5, wherein the shape-endowing inner wall projects beyond the side of the first enclosing section facing the mold interior.

9. Continuous casting mold according to claim 5, wherein the second enclosing section of the displaceable end walls contains the secondary coolant chamber and the secondary coolant channels.

10. Continuous casting mold according to claim 1, for continuously casting rolling or extrusion ingots of light weight metal or light weight metal alloys.

11. Continuous casting mold according to claim 10, wherein said alloys are of aluminum or magnesium.

12. Process for continuously casting metal ingots by means of a continuous casting mold including a mold frame having a pair of stationary facing side walls and a pair of facing end walls defining a modular rectangular mold construction, wherein at least one end wall can be displaced and each side wall and each end wall includes a Primary coolant chamber, a plurality of primary cooling channels for letting coolant onto the ingot material connected to said primary coolant chamber and a secondary coolant chamber only in said displaceable end walls with a plurality of secondary coolant channels connected to the secondary coolant chamber for letting coolant onto the continuously cast material, the process including pouring molten metal into the mold; lowering a mold dummy base which has fixed dimensions cooling the molten metal by coolant ejected from each primary coolant chamber of each side wall and end wall; further cooling the molten metal by coolant ejected from the secondary coolant chamber of each end wall; and regulating the position of each displaceable end wall using a drive regulated by a control unit, including the steps of initially setting the distance between the end walls such that, at the start of the casting process, the cross-section of the mold interior corresponds to the surface area of the lowerable mold dummy base available to accommodate the material being cast and, in the course of the continuous casting process the distance between the end walls is adjusted by means of the drive regulated by the control unit in such a program-controlled manner, in coordination with the lowering of the mold dummy base, such that the cross-section of the mold interior is adjusted continuously or stepwise to the dimensions of the ingot desired.

13. Process according to claim 12, wherein the control unit functions on the basis of a fixed predetermined, time-dependent program.

14. Process according to claim 12, wherein the position of each adjustable end wall can be determined at each point in time by a position measurement facility, and wherein the positioning of the end walls effected by the control unit and drive mechanism takes place on the basis of the difference between the measured, time-dependent position of the end walls and a time-dependent position calculated by a predetermined program.

15. Process according to claim 12, wherein the length of the blunted pyramid or blunted cone part of the ingot, determined by the regulation of the ingot cross-section at the start of the continuous casting process, is less than 50 cm.

16. Process according to claim 15, wherein said length is less than 30 cm.

* * * * *

UNITED STATES PATENT AND TRADEMARK OFFICE

CERTIFICATE OF CORRECTION

PATENT NO. : 5,931,216
DATED : August 3, 1999
INVENTOR(S) : BERTRAND CARRUPT ET AL.

It is certified that error appears in the above-identified patent and that said Letters Patent is hereby corrected as shown below:

Column 10, claim 2, line 36, "40" should read --40°--.

Column 10, claim 3, line 40, "850" should read --85°--.

Column 11, claim 12, line 15, "Primary" should read --primary--.

Column 11, claim 12, line 17, "letting" should read --jetting--.

Column 11, claim 12, line 21, "letting" should read --jetting--.

Column 11, claim 12, line 24, after "dimensions" a --;-- should be inserted.

Signed and Sealed this

Twenty-seventh Day of June, 2000

*Attest:*

*Attesting Officer*

Q. TODD DICKINSON

*Director of Patents and Trademarks*